United States Patent [19]

Mermelstein et al.

[11] Patent Number: 4,844,821

[45] Date of Patent: Jul. 4, 1989

[54] STABLE LIQUID LAUNDRY DETERGENT/FABRIC CONDITIONING COMPOSITION

[75] Inventors: Robert Mermelstein; Frederick A. Hartman, both of Cincinnati, Ohio

[73] Assignee: The Procter & Gamble Company, Cincinnati, Ohio

[21] Appl. No.: 154,552

[22] Filed: Feb. 10, 1988

[51] Int. Cl.[4] ..... D06M 13/26; D06M 13/46

[52] U.S. Cl. ..... 252/8.7; 252/8.6; 252/8.8; 252/531; 252/539; 252/550; 252/558; 252/174.25; 252/DIG. 4

[58] Field of Search ..... 252/8.6, 8.9, 547, 174.23, 252/DIG. 2, 174.25

[56] References Cited

U.S. PATENT DOCUMENTS

| | | | |
|---|---|---|---|
| 2,531,427 | 11/1950 | Hauser | 260/448 |
| 2,966,506 | 12/1960 | Jordan | 260/448 |
| 3,904,533 | 9/1975 | Neiditch et al. | 252/547 |
| 3,944,663 | 3/1976 | Weiss et al. | 252/548 |
| 3,948,790 | 4/1976 | Speakman | 252/120 |
| 3,989,631 | 11/1976 | Marsan | 252/8.6 |
| 4,118,441 | 10/1978 | Le Blanc | 252/8.511 |
| 4,287,086 | 9/1981 | Finlayson et al. | 252/316 |
| 4,292,035 | 9/1981 | Battrell | 252/547 |
| 4,469,605 | 9/1984 | Ramaehandran et al. | 252/8.6 |
| 4,517,112 | 5/1985 | Mardis et al. | 252/315.2 |

FOREIGN PATENT DOCUMENTS

| | | |
|---|---|---|
| 62-167216 | 7/1987 | Japan . |
| 1400898 | 7/1975 | United Kingdom . |

OTHER PUBLICATIONS

NL Chemicals, "BENTONE 14 Rheological Additive", Product Description No. DS 154 (8/82).

*Primary Examiner*—Paul Lieberman
*Assistant Examiner*—Susan B. Franklin
*Attorney, Agent, or Firm*—Chester C. Cekala; Leonard W. Lewis; Steven J. Goldstein

[57] ABSTRACT

Disclosed are stable liquid laundry detergent and liquid fabric softener compositions containing a Smectite-type clay fabric softener and an antisettling agent in a low water/polyol formulation and, optionally, a softness enhancing amount of a polymeric clay-flocculating agent. Also disclosed is a method for producing these compositions and a step-wise method of using them to obtain fabric softening.

22 Claims, No Drawings

STABLE LIQUID LAUNDRY DETERGENT/FABRIC CONDITIONING COMPOSITION

TECHNICAL FIELD

This invention relates to liquid laundry care compositions (i.e., liquid laundry detergent compositions and liquid fabric softener compositions). More specifically, the invention relates to stable low water/polyol content liquid laundry detergent and liquid fabric softener compositions containing a Smectite-type clay fabric softener in combination with an antisettling agent and, optionally, a softness enhancing amount of a polymeric clay-flocculating agent. This invention also relates to a process for producing the stable compositions and a method for using the compositions in a laundry bath.

BACKGROUND OF THE INVENTION

British Pat. No. 1,400,898, Storm and Nirschl, published July 23, 1975, discloses detergent compositions comprising, as a fabric-softening ingredient, a Smectite-type clay. Any Smectite-type clay having a cation exchange capacity of at least 50 meq/100 g is taught to be suitable.

It is now well recognized in the detergent industry that clays of the type disclosed in British Pat. No. 1,400,898 provide significant fabric softening benefits when used in a laundry detergent. It is equally well-recognized that the deposition of these clays onto the fabrics during the laundering process is far from complele; in fact, under typical European laundry conditions, less than half of the available clay is deposited onto the fabrics, the remainder being rinsed away with the laundry liquor during the rinsing cycles.

British Pat. Application No. 87-22844, Raemdonck and Busch, published Nov. 4, 1987, discloses granular and liquid detergent compositions containing a Smectite-type clay fabric softener and a polymeric clay-flocculating agent, from which the clay particles are more effectively deposited onto the fabrics during the laundering process. By enhancing clay deposition, more uniform fabric softening is produced and lower clay content in the detergent compositions can be used.

Product stability tends to be a problem with liquid clay-containing laundry detergent compositions. Generally, where such a composition contains both a clay and a flocculating agent (such as those described in British Application No. 87-22844), the flocculating agent tends to cause the clay to settle to the bottom of the product bottle.

In certain product environments, the clay itself may stabilize the detergent composition. For example, in typical claycontaining liquid laundry care compositions, many clays selfstabilize due to swelling in the high water-content environment. In low water content systems, however, another means must be employed to stabilize the clay.

It is well-known that organic compounds which contain a cation will react under favorable conditions by ion-exchange with clays which contain a negative layer-lattice and exchangeable cations to form organophillic organic-clay products. If the organic cation contains at least one alkyl group with 10 or more carbon atoms, then such organo-clays swell in certain organic liquids. See, for example, Finlayson, et al., U.S. Pat. No. 4,287,086; Hauser, U.S. Pat. No. 2,531,427; Jordon, U.S. Pat. No. 2,966,506; and the book "Clay Mineralogy", 2nd Edition, 1968 by Ralph E. Grim (McGraw-Hill Book Co., Inc.), particularly Chapter 10 (Clay-Mineral-Organic Reactions), pp. 356–368 (Ionic Reactions, Smectite), and pp. 392–401 (Organophillic Clay-Mineral Complexes), all incorporated herein by reference.

M-P-A ® 14, an organically modified montonorillonite clay, manufactured by NL Industries, is described as an antisettling additive for solvent-based organic systems. (See NL Industries product description No. DS 154, 8/82). NL Industries also manufactures the BENTONE ® family of rheological additives which exhibit similar organophillic properties.

Japanese Patent Application 62 [1987]-167216, Seiji Abe and Masayoshi Nakamura, published July 23, 1987, discloses a stable aqueous zeolite suspension which consists essentially of from 40% to 55% of a dehydrated zeolite with a particle size of from 0.1 to 10 μm, and from 0.001% to 0.1% of a lipopolysaccharide biosurfactant. This aqueous zeolite suspension is described as being easier to handle for chemical processing unit operations.

It is an object of the present invention to provide a stable and aesthetically acceptable liquid fabric softener or heavy duty liquid detergent composition containing a Smectite-type clay in a low water/polyol content system.

It is also an object of the present invention to provide a stable and aesthetically acceptable liquid fabric softener, heavy duty liquid detergent or liquid delicate fabric detergent composition having a low water/polyol content, containing a fabric softening Smectite-type clay in combination with a clay-flocculating agent.

It is also an object of the present invention to describe a process for preparing stable clay-containing laundry detergent and fabric softener compositions, as well as a method for their use.

SUMMARY OF THE INVENTION

The compositions of the present invention encompass stable liquid laundry detergent or stable liquid fabric softener compositions (referred to generically herein as laundry care compositions) comprising from about 1% to about 25% of a Smectite-type clay having a longest individual particle dimension of less than about one micron and an ion exchange capacity of at least about 50 meq/100 g, from about 0.25% to about 5% of an antisettling agent selected from the group consisting of organophillic quaternized organo-clays and fumed silicas, and from about 5% to about 45% of a solution of water and from about 0% to about 5% of a polyol containing from about 2 to about 6 carbon atoms and from about 2 to about 6 hydroxy groups, such that the combined polyol and water content of the composition does not exceed about 45%. Preferred compositions additionally comprise an effective softness enhancing amount, preferably from about 0.001% to about 10%, of a polymeric clay-flocculating agent, such as polyethylene oxide with a molecular weight between about 300,000 and about 5,000,000.

The invention also includes a method for producing these novel compositions whereby all or part of the composition is passed through a high shear mixer, which serves to reduce the clay particle size to below about 1 μm and to fully activate the antisettling agent in the low water/polyol system.

Finally, the present invention encompasses a method of softening fabrics whereby the fabrics are placed in an aqueous bath, the composition of the present invention is then added to the bath at a concentration from about 0.0004% to about 2% and agitation begins immediately (i.e., not later than about 5 minutes after addition of the composition).

DETAILED DESCRIPTION OF THE INVENTION

Percentages and ratios herein are by weight, unless otherwise specified.

The liquid laundry care compositions of the present invention include both laundry detergent compositions and fabric softener compositions and comprise a Smectite-type clay, an antisettling agent and low levels of a water/polyol mixture. The compositions may further comprise a polymeric clay-flocculating agent. Each of these components, as well as additional optional fabric softener/liquid laundry detergent components, are described in detail below.

FABRIC SOFTENING CLAYS

The first essential component of the present compositions consist of particular Smectite-type fabric softening clay materials. These Smectite-type clays are present in the liquid fabric care composition in a fabric softening amount, preferably from about 1% to about 25%, more preferably from about 2% to about 7%, by weight of the total composition.

The clay minerals can be described as three-layer clays, i.e., alumino-silicates and magnesium silicates, having an ion exchange capacity of at least about 50 meq/100 g of clay. The three-layer expandable clays used herein are those materials classified geologically as Smectites.

There are two distinct classes of Smectite-type clays; in the first, aluminum oxide is present in the silicate crystal lattice; in the second, magnesium oxide is present in the silicate crystal lattice. The general formulas of these Smectites are $Al_2(Si_2O_5)_2(OH)_2$ and $Mg_3(Si_2O_5)_2(OH)_2$, for the aluminum and magnesium oxide type clay, respectively. It is to be recognized that the range of the water of hydration in the above formulas can vary with the processing to which the clay has been subjected. Furthermore, atom substitution by iron and magnesium can occur within the crystal lattice of the Smectites, while metal cations such as $Na+$, $Ca++$, as well as $H+$, can be co-present in the water of hydration to provide electrical neutrality. Except as noted hereinafter, such cation substitutions are immaterial to the use of the clays herein since the desirable physical properties of the clays are not substantially altered thereby.

The three-layer, alumino-silicates useful herein are further characterized by a dioctahedral crystal lattice, while the three-layer magnesium silicates have a trioctahedral crystal lattice.

As noted hereinabove, the clays employed in the compositions of the instant invention contain cationic counterions, such as protons, sodium ions, potassium ions, calcium ions, magnesium ions, and the like. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a Smectite-type clay is expressed by the following equation:

$$\text{Smectite-type clay (Na)} + NH_4OH = \text{Smectite-type clay } (NH_4) + NaOH$$

Since in the foregoing equilibrium reaction, one equivalent weight of ammonium ion replaces an equivalent weight of sodium, it is customary to measure cation exchange capacity (sometimes termed "base exchange capacity") in terms of milli-equivalents per 100 g of clay (meq/100 g).

Cation exchange capacity of the clay is a well-known parameter in determining the clay's effectiveness as a fabric softener. The cation exchange capacity may be determined by well-established analytical techniques. See, for example, H. van Olphen, "Clay Colloid Chemistry", Interscience Publishers, 1963, and the relevant references cited therein. It is preferred that the clay particles used in the present invention have a cation exchange capacity of at least about 50 meq/100 g.

The Smectite-type clays used in the compositions herein are well-known and many are commercially available. Such clays include, for example, montmorillonite, volchonskoite, nontronite, hectorite, saponite, sauconite, and vermiculite. The clays herein are available under various trade names, for example, Thixogel No. 1 (also, "Thixo-Jell") and Gelwhite GP from Georgia Kaolin Co., Elizabeth, New Jersey; Volclay BC and Volclay No. 325, from American Colloid Co., Skokie, Illinois; Black Hills Bentonite BH450, from International Minerals and Chemicals; and Veegum Pro and Veegum F, from R. T. Vanderbilt. It is to be recognized that such Smectite-type minerals obtained under the foregoing trade names can comprise mixtures of the various discreet mineral entities. Such mixtures of the Smectite minerals are suitable for use herein.

While any of the Smectite-type clays described herein are useful in the present invention, certain clays are preferred. For example, Gelwhite GP is an extremely white form of Smectite-type clay and is therefore preferred when formulating white granular detergent compositions. Volclay BC, which is a Smectite-type clay mineral containing at least 3% iron (expressed as $Fe_2O_3$) in the crystal lattice, and which has a very high ion exchange capacity, is one of the most efficient and effective clays for use in the instant compositions from the standpoint of product performance. On the other hand, certain Smectite-type clays are sufficiently contaminated by other silicate minerals that their ion exchange capacities fall below the requisite range; such clays are of no use in the instant compositions.

Appropriate clay minerals for use herein can be selected by virtue of the fact that Smectites exhibit a true 14A x-ray diffraction pattern. This characteristic pattern, taken in combination with exchange capacity measurements performed in the manner noted above, provides a basis for selecting particular Smectite-type minerals for use in the composition disclosed herein.

Conventional liquid laundry detergent or fabric softener compositions containing expandable hydrophillic clays self-stabilize in high water content systems and do not settle out because clay particle swelling provides a stable matrix. However, in laundry care compositions having a combined water and polyol content of less than about 45% (i.e., low water content) the clay cannot self-stabilize. These low water/polyol systems are the subject of the present invention. In order to provide a stable product, the clay particle size must be such that the longest dimension is less than about 1 $\mu$m, resulting in a colloidal suspension.

The particle size distribution of the clay particles can be determined using transmission electron microscopy (TEM) techniques. Details of sample preparation techniques are described in the "Atlas of Electron Microscopy of Clay Minerals and their Admixtures", Elsevier Publishing Company, 1968. The preferred sample preparation involves the use of a mixture of water and t-butylamine (700:1) as the peptizer for clay particles. This makes it possible to obtain TEM micrographs of mineral particles, rather than aggregates. Good results are obtained with suspensions in water/t-butylamine (700:1) applied to a carbon-coated grid, using accelerating voltages of from 60 to 80 kV. Particle size averages obtained with TEM are number averages. Particle dimensions are used herein are number average particle dimensions.

ANTISETTLING AGENTS

The second essential component of the present invention is an antisettling agent. A suitable antisettling agent must provide a fully activated support matrix to suspend clay particles and optionally, dispersed flocculating agent, within the liquid laundry care compositions. The antisettling agent must also be able to produce this matrix in a low water/polyol system (i.e, a combined water and polyol content between about 5% and about 45%). Finally, an acceptable antisettling agent must not adversely effect the viscosity, elasticity or aesthetics of the product. These agents, or mixtures thereof, are used in the compositions of the present invention at levels of from about 0.25% to about 5%, preferably from about 0.5% to about 2%.

The Bentone® family of organo-clays, manufactured by NL Industries, and fumed silicas are examples of antisettling agents suitable for use in the present invention. Bentone® rheological additives are described as the reaction products of a clay which contains a negative layer-lattice and an organic compound which contains a cation and at least one alkyl group containing at least 10 carbon atoms. Bentone® organo-clays have the property of swelling in certain organic liquids. Organophillic quaternized ammonium-clay compounds are preferred antisettling agents. (See, U.S. Pat. No. 4,287,086, Finlayson, et al., Sept. 1, 1981, incorporated herein by reference). An organophillic organo-montmorillonite, M-P-A 14® antisettling additive, manufactured by NL Industries, is the preferred antisettling agent due to its excellent viscosity stability, small effect on apparent viscosity of the liquid detergent system, good dispersion characteristics and ease of activation via high shear mixing.

M-P-A® 14 antisettling additive requires a liquid shear rate of at least about 10,000 $sec^{-1}$ during its addition to the composition in order to form a fully activated support network in the liquid laundry-care system.

Fumed silicas also provide excellent antisettling characteristics to the compositions of the present invention. Fumed silicas are generally defined as a colloidal form of silica made by combustion of silicon tetrachloride in a hydrogen-oxygen furnace. Fumed silicas are normally used as thickener, thixotropic and reinforcing agents in inks, resins, rubber, paints and cosmetics. CAB-O-SIL® brand fumed silicas, manufactured by Cabot Corp., are suitable antisettling agents for use in this invention.

Mixtures of organo-clays and fumed silicas are also suitable antisettling agents.

The rheological characteristics of the resulting liquid detergent system are very important to a commercially acceptable product. A liquid detergent which can be described as stringy (i.e., elastic), thick or lumpy is undesirable. The antisettling agents described above avoid these undesirable rheological properties while maintaining a pourable, homogeneous product with good consumer appeal. A liquid laundry care composition viscosity in the range of from about 100 to about 1000 cP is desirable.

It is also essential for the liquid detergent compositions to exhibit plastic rheology. Materials that exhibit plastic flow characteristics will flow only after an applied shearing stress exceeds a critical minimum value. This minimum shearing stress is designated as the "Yield Value".

At stresses below the yield value, the system displays the rheology of a solid, whereas at shearing stresses above the yield value, the system exhibits liquid-like rheology. This allows the suspension of insoluble particles in systems at rest, while still permitting the composition to flow easily once the yield value has been exceeded.

The yield value of a plastic system is commonly determined by extrapolation of the shear rate vs. shear stress curve to zero shear rates. The yield value can be approximated by measurement of Brookfield Yield Value (BYV) using a Brookfield RVT viscometer. (See, *Soap/Cosmetics/Chemical Specialties,* April, 1985, pg. 46).

$$\text{Brookfield Yield Value} = \frac{(\text{Apparent Viscosity at 0.5 rpm} - \text{Apparent Viscosity at 1 rpm})}{100}$$

For systems containing insoluble particles or droplets, the stability against separation can be calculated from the Brookfield Yield Value. The minimum BYV for permanent suspension can be calculated using the equation:

$$BYV = [23.6\ R\ (D - D)g]^{\frac{2}{3}}$$

Where

BYV = Minimum Brookfield Yield Value for permanent suspension

R = Particle Radius

D = Density of Particle $D_o$ = Density of Medium g = Acceleration Due to Gravity.

It has been established that the minimum yield value to support the clay and flocculating agent in the preferred compositions of the present invention is about 1.5 dynes/$cm^2$. The antisettling additives described above achieve yield values above this limit.

CLAY-FLOCCULATING AGENTS

The compositions of the present invention may also include a polymeric fabric softness enhancing amount of a clay-flocculating agent.

It has been found that polymeric clay-flocculating agents enhance the deposition of fabric-softening clays onto fabrics. The amount of clay-flocculating agent to be used in the present detergent compositions must be such that the deposition of the softening clay onto fabrics is enhanced, but remains substantially uniform. For a given polymeric clay-flocculating agent, the amount to be used in the detergent composition can be readily determined in a simple level study using the clay deposition test described below. Polymeric clay-flocculating agent levels between about 0.0001% and about 10% are preferred.

Clay-flocculating agents are not commonly used in detergent compositions. On the contrary, clay dispersents, which aid in removing clay stains from fabrics, are frequently included in detergents. Such flocculating agents are, however, very well-known for other uses, including oil well drilling and ore flotation. Most of these materials are fairly long chain polymers and copolymers derived from such monomers as ethylene oxide, acrylamide, acrylic acid, dimethylamino ethyl methacrylate, vinyl alcohol, vinyl pyrrolidone, and ethylene imine. Gums, like guar gum, are suitable as well. Mixtures of these clay-flocculating agents may also be used. Preferred are polymers of ethylene oxide, acryl amide, and/or acrylic acid.

It has been found that these polymers dramatically enhance the deposition of a fabric softening clay if their molecular weights (weight average) are greater than about 300,000, preferably between about 300,000 and about 5,000,000.

The most preferred polymer is polyethylene oxide. The content of polyethylene oxide in the product is preferably between about 0.001% and about 10%, more preferably between about 0.01% and about 0.3%.

The insolubility of the flocculating agent is critical in preventing flocculation of the clay suspension in the liquid detergent matrix. Since water and polyols are good solvents for most of the flocculating agents described above, their levels must be sufficiently low to prevent solvency toward the clay-flocculating agent. This produces insoluble suspended particles or droplets of the clay-flocculating agent in the compositions.

A water/polyol content between about 5% and about 45% is preferred. Polyols are better solvents for the described polymeric clay-flocculating agents, as a result, the polyol level in the composition must be in the range of from about 0% to about 5%, such that the combined water/polyol content does not exceed 45%.

Suitable polyols of the present invention contain from about 2 to about 6 carbon atoms and from about 2 to about 6 hydroxy groups. Preferred polyols are 1,2-propanediol, ethylene glycol and glycerol. The most preferred polyol is 1,2-propanediol.

CLAY DEPOSITION TEST

Washloads containing 6 cotton bath towels, 1 pillow case, 9 cotton t-shirts, and 6 cotton terry hand towels are laundered in a Miele washer containing 16 liters of water at 60° C. for four complete cycles with various liquid detergents at a 1% level. Three line-dried hand towels from each washload are randomly selected for analysis. A 1-inch diameter circular section from an unhandled area of each cloth is punched out and compressed on a 30-ton hydraulic press using 600 psi pressure to form a wafer. These wafers are placed in an EDAX 9500 X-ray fluorescence unit (North American Phillips Corp.) with a rhodium anode X-ray tube, where their surfaces are bombarded with X-rays for 100 live seconds under a vacuum to determine their elemental compositions (X-ray parameters are 15 KV and 500 microamperes). The silicon "counts" of the surfaces are proportional to the levels of deposited clay. The three determinations per detergent treatment are averaged, and a baseline value of silicon obtained for non-clay treated towels is subtracted from the average to give a net silicon count. This is reported as a measure of clay deposition. A net silicon count of from about zero to about three correlates with very poor deposition. Counts of from about three to about seven have fair deposition. Laundry-care compositions which produce more than about seven counts are preferred.

OPTIONAL SOFTENING INGREDIENTS

The compositions of the present invention may further contain, in addition to the clay material, other softening ingredients. Suitable examples include amines of the formula $R_1R_2R_3N$, wherein $R_1$ is $C_6$ to $C_{20}$ hydrocarbyl, $R_2$ is $C_1$ to $C_{20}$ hydrocarbyl, and $R_3$ is $C_1$ to $C_{10}$ hydrocarbyl or hydrogen. A preferred amine of this type is ditallowmethylamine.

Preferably, the softening amine is present as a complex with a fatty acid of the formula $R^4COOH$, wherein $R^4$ is a $C_9$ to $C_{20}$ alkyl or alkenyl. It is desirable that the amine/fatty acid complex be present in the form of microfine particles, having a particle size in the range of from, e.g., about 0.1 to about 20 micrometers. These amine/fatty acid complexes are disclosed more fully in European Patent Application No. 0,133,804, the disclosures of which are incorporated herein by reference. Preferred are compositions that contain from about 1% to about 10% of the amine.

Suitable also are complexes of the above-described amines together with phosphate esters of the formula:

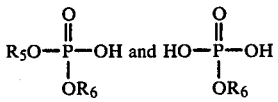

wherein $R_5$ and $R_6$ are $C_1$–$C_{20}$ alkyl, or ethoxylated alkyl groups of the general formula alkyl—$(OCH_2CH_2)_y$, wherein the alkyl substituent is $C_1$–$C_{20}$, preferably $C_8$–$C_{16}$, and y is an integer of 1 to 15, preferably 2–10, most preferably 2–5. Amine/phosphate ester complexes of this type are more fully disclosed in European Patent Application No. 0,168,889, the disclosures of which are incorporated herein by reference.

Further examples of optional softening ingredients include the softening amides of the formula $R_7R_8NCOR_9$, wherein $R_7$ and $R_8$ are independently selected from $C_1$–$C_{22}$ alkyl, alkenyl, hydroxyalkyl, aryl, and alkyl-aryl groups; $R_9$ is hydrogen, or a $C_1$–$C_{22}$ alkyl or alkenyl, an aryl or alkyl-aryl group. Preferred examples of these amides are ditallow acetamide and ditallow benzamide. Good results are obtained when the amides are present in the composition in the form of a composite with a fatty acid or with a phosphate ester, as described hereinbefore of the softening amines.

The amides are present in the composition at from about 1% to about 10% by weight.

Suitable softening ingredients are also the amines disclosed in U.K. Patent Application No. GB 2,173,827, the disclosures of which are incorporated herein by reference, in particular the substituted cyclic amines disclosed therein. Suitable are imidazolines of the general formula 1-(higher alkyl) amido (lower alkyl)-2-(higher alkyl)imidazoline wherein higher alkyl has from about 12 to about 22 carbon atoms, and lower alkyl has from about 1 to about 4 carbon atoms.

A preferred cyclic amine is 1-tallowamidoethyl-2-tallowimidazoline. Preferred compositions contain from about 1% to about 10% of the substituted cyclic amine.

OPTIONAL DETERGENT COMPOUNDS

Laundry care compositions of the present invention can also contain conventional detergent components and adjuvants at their art-established levels, provided the resulting mixture of detergent components has minimal (preferably none) solvency toward the flocculating agent.

DETERSIVE SURFACTANTS

The surfactant component can comprise as little as about 1% of the compositions herein, but preferably the compositions will contain from about 5% to about 40%, more preferably from about 10% to about 30%, of surfactant.

Combinations of anionic (preferably linear alkyl benzene sulfonates) and nonionic (preferably alkyl polyethoxylated alcohols) surfactants are preferred for optimum combined cleaning and textile softening performance, but other classes of surfactants, such as semipolar, ampholytic, zwitterionic, and cationic may be used. Mixtures of these surfactants can also be used.

A. Nonionic Surfactants

Suitable nonionic surfactants are generally disclosed in U.S. Pat. No. 3,929,678, Laughlin et al., issued Dec. 30, 1975, at column 13, line 14 through column 16, line 6, incorporated herein by reference. Classes of useful nonionic surfactants include:

1. The polyethylene oxide condensates of alkyl phenols. These compounds include the condensation products of alkyl phenols having an alkyl group containing from about 6 to about 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation; and Triton X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 4 to about 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 moles of ethylene oxide. Examples of commercially available nonionic surfactants of this type include Tergitol 15-S-9 moles (the condensation product of $C_{11}$–$C_{15}$ linear alcohol with 9 moles ethylene oxide), Tergitol 24-L-6 NMW (the condensation product of $C_{12}$–$C_{14}$ primary alcohol with 6 moles ethylene oxide with a narrow molecular weight distribution), both marketed by Union Carbide Corporation; Neodol 45-9 (the condensation product of $C_{14}$–$C_{15}$ linear alcohol with 9 moles of ethylene oxide), Neodol 23-6.5 (the condensation product of $C_{12}$–$C_{13}$ linear alcohol with 6.5 moles of ethylene oxide), Neodol 45-7 (the condensation product of $C_{14}$–$C_{15}$ linear alcohol with 7 moles of ethylene oxide), Neodol 45-4 (the condensation product of $C_{14}$–$C_{15}$ linear alcohol with 4 moles of ethylene oxide), all marketed by Shell Chemical Company; and Kyro EOB (the condensation product of $C_{13}$–$C_{15}$ alcohol with 9 moles ethylene oxide), marketed by The Proctor & Gamble Company.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecules as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

5. Semi-polar nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred semi-polar nonionic detergent surfactants are the amine oxide surfactants having the formula $$R^{10}(OR^{11})_xN(R^{12})_2 \rightarrow O$$

wherein $R^{10}$ is an alkyl, hydroxyalkyl, or alkyl phenyl group or mixtures thereof containing from about 8 to about 22 carbon atoms; $R^{11}$ is an alkylene or hydroxyalkylene group containing from about 2 to about 3 carbon atoms or mixtures thereof; x is from 0 to about 3; and each $R^{12}$ is an alkyl or hydroxyalkyl group containing from about 1 to about 3 carbon atoms or a polyethylene oxide group containing from about 1 to about 3 ethylene oxide groups. The $R^{12}$ groups can be attached to each other, e.g., through an oxygen or nitrogen atom, to form a ring structure.

Preferred amine oxide surfactants are $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.5 to about 10, preferably from about 1.5 to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^{13}O(C_nH_{2n}O)_t(\text{glycosyl})_x$$

wherein $R_{13}$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

7. Fatty acid amide surfactants having the formula:

$$R^{14}-\overset{\overset{\displaystyle O}{\|}}{C}-N(R^{15})_2$$

wherein $R^{14}$ is an alkyl group containing from about 7 to about 21 (preferably from about 9 to about 17) carbon atoms and each $R^{15}$ is selected from the group consisting of hydrogen, $C_1$–$C_{14}$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanolamides.

B. Anionic Surfactants

Anionic surfactants suitable for use in the present invention are generally disclosed in U.S. Pat. No. 3,929,678, Laughlin et al., issued Dec. 30, 1975, at column 23, line 58 through column 29, line 23, and in U.S. Pat. No. 4,294,710, Hardy et al., issued Oct. 13, 1981, both of which are incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, preferably from about 10 to about 20 carbon atoms. Preferred alkali metal soaps are sodium laurate, sodium stearate, sodium oleate and potassium palmitate.

2. Water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.)

Examples of this group of anionic surfactants are the sodium and potassium alkylbenzene sulfonates in which the alkyl group contains from about 9 to about 15 carbon atoms in straight chain or branched chain configuration, e.g., those of the type described in U.S. Pat. No. 2,220,099, Guenther et al., issued Nov. 5, 1940, and U.S. Pat. No. 2,477,383, Lewis, issued Dec. 26, 1946. Especially useful are linear straight chain alkylbenzene sulfonates in which the average number of carbon atoms in the alkyl group is from about 11 to about 13, abbreviated as $C_{11}$–$C_{13}$LAS.

Other anionic surfactants of this type include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Also included are water-soluble salts of esters of alphasulfonated fatty acids containing from about 6 to about 20 carbon atoms in the fatty acid group and from about 1 to about 10 carbon atoms in the ester group; water-soluble salts of 2-acyloxyalkane-1-sulfonic acids containing from about 2 to about 9 carbon atoms in the acyl group and from about 9 to about 23 carbon atoms in the alkane moiety; alkyl ether sulfates containing from about 10 to about 20 carbon atoms in the alkyl group and from about 1 to about 30 moles of ethylene oxide; water-soluble salts of olefin sulfonates containing from about 12 to about 24 carbon atoms; and beta-alkyloxy alkane sulfonates containing from about 1 to about 3 carbon atoms in the alkyl group and from about 8 to about 20 carbon atoms in the alkane moiety.

3. Anionic phosphate surfactants.

4. N-alkyl substituted succinamates.

C. Ampholytic Surfactants

Ampholytic surfactants can be broadly described as aliphatic derivatives of secondary or tertiary amines, or alphatic derivatives of heterocyclic secondary and tertiary amines in which the aliphatic radical can be straight or branched chain and wherein one of the aliphatic substituents contains from about 8 to about 18 carbon atoms and at least one of the alphatic substituents contains an anionic water-solubilizing group, e.g., carboxy, sulfonate, sulfate. See U.S. Pat. No. 3,929,678, Laughlin et al., issued Dec. 30, 1975, column 19, line 38 through column 22, line 48, incorporated herein by reference, for examples of ampholytic surfactants useful herein.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678, Laughlin et al., issued Dec. 30, 1975, column 19, line 38 through column 22, line 48, incorporated herein by reference, for examples of zwitterionic surfactants useful herein.

E. Cationic Surfactants

Cationic surfactants are the least preferred detergent surfactants useful in detergent compositions of the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solutions pH values less than about 8.5.

Suitable cationic surfactants include the quaternary ammonium surfactants having the formula:

$$[R^{16}(OR^{17})_y][R^{18}(OR^{17})_y]_2R^{19}N^+X^-$$

wherein $R^{16}$ is an alkyl or alkyl benzyl group having from about 8 to about 18 carbon atoms in the alkyl chain; each $R^{17}$ is independently selected from the group consisting of $-CH_2CH_2-$, $-CH_2CH(CH_3)-$, $-CH_2CH(CH_2OH)-$, and $-CH_2CH_2CH_2-$; each $R^{18}$ is independently selected from the group consisting of $C_1$–$C_4$ alkyl, $C_1$–$C_4$ hydroxyalkyl, benzyl, ring structures formed by joining the two $R^{18}$ groups, $-CH_2CHOHCHOHCOR^{20}CHOHCH_2OH$ wherein $R^{20}$ is any hexose or hexose polymer having a molecular weight less than about 1000, and hydrogen when y is not 0; $R^{19}$ is the same as $R^{18}$ or is an alkyl chain wherein the total number of carbon atoms of $R^{16}$ plus $R^{19}$ is not more than about 18; each y is from 0 to about 10 and the sum of the y values is from 0 to about 15; and X is any compatible anion.

Examples of the above compounds are alkyl quaternary ammonium surfactants, especially the mono-long chain alkyl surfactants described in the above formula when $R^{19}$ is selected from the same groups as $R^{18}$. The most preferred quaternary ammonium surfactants are the chloride, bromide and methylsulfate $C_8$–$C_{16}$ alkyl trimethylammonium salts, $C_8$–$C_{16}$ alkyl di(hydroxyethyl)methylammonium salts, the $C_8$–$C_{16}$ alkyl hydroxyethyldimethylammonium salts, and $C_8$–$C_{16}$ alkyloxypropyltrimethylammonium salts. Of the above, decyl trimethylammonium methylsulfate, lauryl trimethylammonium chloride, myristyl trimethylammonium bromide and coconut trimethylammonium chloride and methylsulfate are particularly preferred.

A more complete disclosure of these and other cationic surfactants useful herein can be found in U.S. Pat. No. 4,228,044, Cambre, issued Oct. 14, 1980, incorporated herein by reference.

DETERGENT BUILDERS

Detergent compositions of the present invention may contain inorganic and/or organic detergent builders to assist in mineral hardness control. Built liquid formulations preferably comprise from about 5% to about 50%, preferably about 5% to about 30%, by weight of detergent builder.

Useful water-soluble organic builders include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citrate. The citrate (preferably in the form of an alkali metal or alkanolammonium salt) is generally added to the composition as citric acid, but can be added in the form of a fully neutralized salt.

Highly preferred polycarboxylate builders are disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates disclosed in U.S. Pat. No. 3,723,322, Diehl, issued Mar. 28, 1973, incorporated herein by reference.

A class of useful phosphorus-free detergent builder materials has been found to be ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al., U.S. Pat. No. 3,635,803, issued Jan. 18, 1972, both of which are incorporated herein by reference.

A specific type of ether polycarboxylates useful as builders in the present invention includes those having the general formula:

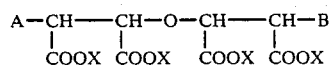

wherein A is H or OH; B is H or

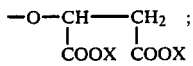

and X is H or a salt-forming cation. For example, if the above general formula A and B are both H, then the compound is oxydissuccinic acid and its water-soluble salts. If A is OH and B is H, then the compound is tartrate monosuccinic acid (TMS) and its water-soluble salts. If A is H and B is

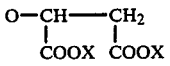

then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

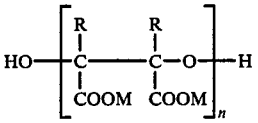

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and is selected from hydrogen, $C_{1-4}$ alkyl or $C_{1-4}$ substituted alkyl (preferably R is hydrogen).

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference.

Useful builders also include sodium and potassium carboxymethyloxymalonate, carboxymethyloxysuccinate, cis-cyclohexanehexacarboxylate, cis-cyclopentanetetracarboxylate phloroglucinol trisulfonate, water-soluble polyacrylates (having molecular weights of from about 2,000 to about 200,000, for example), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Especially useful builders include alkyl succinates of the general formula R—CH(COOH)$CH_2$(COOH), i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: lauryl succinate, myristyl succinate, palmityl succinate, 2-dodecenyl succinate (preferred), 2-pentadecenyl succinate, and the like.

Other useful detergency builders include the $C_{10}$–$C_{18}$ alkyl monocarboxylic (fatty) acids and salts thereof. These fatty acids can be derived from animal and vegetable fats and oils, such as tallow, coconut oil and palm oil. Suitable saturated fatty acids can also be synthetically prepared (e.g., via the oxidation of petroleum or by hydrogenation of carbon monoxide via the Fisher-Tropsch process). Particularly preferred $C_{10}$–$C_{18}$ alkyl monocarboxylic acids are saturated coconut fatty acids, palm kernel fatty acids, and mixtures thereof.

CHELATING AGENTS

The detergent compositions herein may also optionally contain one or more iron manganese chelating agents. Such chelating agents can be selected from the group consisting of amino carboxylates, amino phosphonates, polyfunctionally-substituted aromatic chelating agents and mixtures thereof, as hereinafter defined.

Amino carboxylates useful as chelating agents in compositions of the invention contain one or more, preferably at least two, units of the substructure

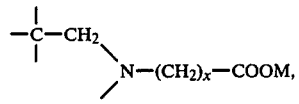

wherein M is hydrogen, alkali metal, ammonium or substituted ammonium (e.g. ethanolamine) and x is from 1 to about 3, preferably 1. Preferably, these amino carboxylates do not contain alkyl or alkenyl groups with more than about 6 carbon atoms. Operable amine carboxylates include ethylenediaminetetraacetates, N-hydroxyethylethylenediaminetriacetates, nitrilotriacetates, ethylenediamine, tetrapropionates, triethylenetetraaminehexaacetates, diethylenetriaminepentaacetates, and ethanoldiglycines, alkali metal, ammonium, and substituted ammonium salts thereof, and mixtures thereof.

Amino phosphonates are also suitable for use as chelating agents in the compositions of the invention when at least low levels of total phosphorus are acceptable for use. Compounds with one or more, preferably at least two, units of the substructure

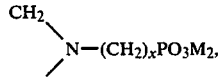

wherein M is hydrogen, alkali metal, ammonium or substituted ammonium and x is from 1 to about 3, preferably 1, are useful and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms. Alkylene groups can be shared by substructures.

Polyfunctionally-substituted aromatic chelating agents are also useful in the compositions herein. These materials comprise compounds having the general formula

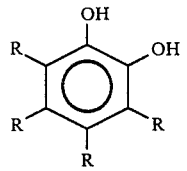

wherein at least one R is —$SO_3H$ or —COOH or soluble salts thereof and mixtures thereof. U.S. Pat. No. 3,812,044, issued May 21, 1974, Connor et al., incorporated herein by reference, discloses polyfunctionally-substituted aromatic chelating and sequestering agents. Preferred compounds of this type in acid form are dihydroxydisulfobenzenes and 1,2-dihydroxy-3,5-disulfobenzene or other disulfonated catechols in particular. Alkaline detergent compositions can contain these materials in the form of alkali metal, ammonium or substituted ammonium (e.g., mono- or triethanolamine) salts.

U.S. Pat. No. 4,704,233, Hartman, et al., issued Nov. 3, 1987, discloses the use of ethylenediamine-N,N'-disuccinic acid or salts thereof as a biodegradable chelant in laundry detergent compositions.

If utilized, these chelating agents will generally comprise from about 0.1% to about 10% by weight of the detergent compositions herein. More preferably, chelating agents will comprise from about 0.1% to about 3% by weight of such compositions.

SOIL RELEASE AGENT

Polymeric soil release agents useful in the present invention include cellulosic derivatives such as hydroxyether cellulosic polymers, copolymeric blocks of ethylene terephthalate and polyethylene oxide or polypropylene oxide terephthalate, cationic guar gums, and the like.

The cellulosic derivatives that are functional as soil release agents are commercially available and include hydroxyethers of cellulose such as Methocel® (Dow) and cationic cellulose ether derivatives such as Polymer JR-124®, JR-400®, and JR-30M® (Union Carbide). See also U.S. Pat. No. 3,928, 213, Temple et al., issued December 23, 1975, incorporated by reference.

Other effective soil release agents are cationic guar gums such as Jaguar Plau® (Stein Hall) and Gendrive 458® (General Mills).

Preferred cellulosic soil release agents for use herein have a viscosity in aqueous solution at 20° C. of 15 to 75,000 centipoise and are selected from the group consisting of methyl cellulose; hydroxypropyl methylcellulose, hydroxybutyl methylcellulose, or mixtures thereof.

A more preferred soil release agent is a copolymer having random blocks of ethylene terephthalate and polyethylene oxide (PEO) terephthalate. More specifically, these polymers are comprised of repeating units of ethylene terephthalate and PEO terephthalate in a mole ratio of ethylene terephthalate units to PEO terephthalate units of from about 25:75 to about 35:65, said PEO terephthalate units containing polyethylene oxide having molecular weights of from about 300 to about 2000. The molecular weight of this polymeric soil release agent is in the range of from about 25,000 to about 55,000. See U.S. Pat. No. 3,959,230. Hays, issued May 25, 1976, and U.S. Pat. No. 3,893,929, Basadur, issued July 8, 1975 (both incorporated by reference), which disclose similar copolymers. It has been found that these polymeric soil release agents provide a more uniform distribution over a range of fabrics and can therefore yield improved fabric care qualities.

Another preferred polymeric soil release agent is a crystallizable polyester with repeat units of ethylene terephthalate units containing about 10–15% by weight of ethylene terephthalate units together with about 80% to about 90% by weight of polyoxyethylene terephthalate units, derived from a polyoxyethylene glycol of average molecular weight about 300–5,000, and the mole ratio of ethylene terephthalate units to polyoxyethylene terephthalate units in the crystallizable polymeric compound is between about 2:1 and about 6:1. Examples of this type of polymer include the commercially available material Zelcon® 5126 (from Dupont) and Milease® T (from ICI).

Preferred soil release polymers and methods for their preparation are described in European Patent Application No. 185,417, Gosselink, published June 25, 1986, which is incorporated herein by reference.

If utilized, these soil release agents will generally comprise from about 0.05% to about 5%, preferably from about 0.2% to about 3%, by weight of the detergent compositions herein.

ENZYMES

Enzymes may be used in the compositions of the present invention at levels of from about 0.025% to about 2%, preferably from about 0.05% to about 1.5%, of the total composition. Preferred proteolytic enzymes should provide a proteolytic activity of at least about 5 Anson units (about 1,000,000 Delft units) per liter, preferably from about 15 to about 70 Anson units per liter, most preferably from about 20 to about 40 Anson units per liter. A proteolytic activity of from about 0.01 to about 0.05 Anson units per gram of product is desirable. Other enzymes, including amylolytic enzymes, are also desirably included in the present compositions.

Suitable proteolytic enzymes include the many species known to be adapted for use in detergent compositions. Commercial enzyme preparations such as "Savinase" and "Alcalase", sold by Novo Industries, and "Maxatase", sold by Gist-Brocades, Delft, The Netherlands, are suitable. Other preferred enzyme compositions include those commercially available under the tradenames SP-72 ("Esperase") manufactured and sold by Novo Industries A/S, Copenhagen, Denmark and "AZ-Protease" manufactured and sold by Gist-Brocades, Delft, The Netherlands.

Suitable amylases include "Rapidase" sold by Gist-Brocades and "Termamyl" sold by Novo Industries.

A more complete disclosure of suitable enzymes can be found in U.S. Pat. No. 4,101,457, Place et al., issued July 18, 1978, and U.S. Pat. No. 4,507,219, Hughes, issued Mar. 26, 1985, both incorporated herein by reference.

In addition to ingredients already mentioned, the compositions of the present invention can include various other optional ingredients typically used in commercial products at their art-established levels, to provide aesthetic or additional product performance benefits. Typical ingredients include pH regulants, pH buffers, perfumes, dyes, optical brighteners, soil suspending agents, enzyme stabilizers, gel-control agents, freeze-thaw stabilizers, bactericides, preservatives, suds control agents, hydrotropes (e.g., ethanol, short chain alkyl sulfonates), bleaches, bleach activators, and the like.

A typical stable softening thru-the-wash liquid detergent comprises:

| | |
|---|---|
| Anionic Surfactant | 10-30% |
| Nonionic Surfactant (e.g., Ethoxylated Fatty Alcohol) | 2-10% |
| Fatty Acid Builder | 0-20% (pref. 5-20%) |
| Citric Acid | 0-3% (pref. 1-3%) |
| Ethanol | 0-8% (pref. 3-8%) |
| Propanediol (Polyol) | 0-5% |
| Triethanolamine | 0-7% (pref. 3-7%) |
| Sodium Hydroxide | 0-7% (pref. 3-7%) |
| Fabric Softening Smectite Clay | 2-7% |
| Antisettling Agent | 0.5-2% |
| Water | 25-45% |
| Polymeric Flocculant | 0-1% (pref. 0.01-0.3%) |
| Miscellaneous | Balance to 100% |

OTHER LIQUID FABRIC SOFTENER COMPONENTS

Liquid Carriers—The carrier normally included in liquid fabric softener compositions is selected from water and mixtures of water and short chain $C_1$-$C_6$ monohydric alcohols. Water is already present at critical levels in the present invention, so the liquid carrier used in the softener compositions of the present invention may be supplemented with from about 10% to about 55% of a short chain alcohol, such as ethanol, propanol, isopropanol or butanol, and mixtures thereof.

Other Optional Ingredients—Adjuvants can be added to the fabric softener composition herein for their known uses at their art-established levels. Such adjuvants include, but are not limited to, cationic softeners, static control agents, viscosity control agents, perfumes, emulsifiers, preservatives, antioxidants, bacteriocides, fungicides, colorants, dyes, fluorescent dyes, brighteners, opacifiers, freeze-thaw control agents, shrinkage control agents, and agents to provide ease of ironing.

| | |
|---|---|
| Fabric Softening Smectite Clay | 1-25% (pref. 2-7%) |
| Water | 25-45% |
| Polyol | 0-5% |
| Antisettling Agent | 0.5-2% |
| Monohydric Alcohol Carrier | 10-55% |
| Other Carrier Solvents | 0-20% |
| Co-Softeners | 0-15% |
| Static Control Agent | 0-5% |
| Polymeric Flocculant | 0-1% (pref. 0.01-0.3%) |
| Miscellaneous | Balance to 100% |

METHODS OF USE

Liquid Detergent—In a through-the-wash mode, the compositions are typically used at a concentration of at least about 400 ppm, preferably about 0.05% to about 1.5%, in an aqueous laundry bath at pH 7-11 to laundr fabrics. The laundering can be carried out at temperatures ranging from about 5° C. to the boil, with excellent results.

Detergent compositions of the present invention require use in a specific step-wise operation in order to provide optimal performance. The detergent composition must be added to the aqueous wash bath simultaneously with or after the clothes are added. Then, agitation of the laundry bath must begin no more than about 5 minutes after the addition of the liquid detergent composition. This will enhance the clay's deposition thereby improving the effectiveness and homogeneity of softening. If the composition is added to the wash water before the laundry, the clay-floccuating agent will cause the clay to agglomerate and settle to the bottom of the laundry bath within about 30 seconds; this reduces the clay's deposition ability. In contrast, when the composition is added to the aqueous laundry bath containing the laundry, and agitation commences immediately, the clay-flocculating agent will cause clay to agglomerate and settle much more homogeneously and effectively upon the fabric.

Liquid Fabric Softener—The liquid fabric softening compositions of this invention are used by adding to the rinse cycle of conventional laundry operations. Generally, rinse water has a temperature of from about 5° C. to about 60° C. The concentration of the fabric softener compositions of this invention is generally from about 0.05% to about 1.5%, preferably from about 0.2% to about 1%, by weight of the aqueous rinsing bath.

In general, the present invention in its fabric softening method aspect comprises the steps of (1) washing fabrics in a conventional washing machine with a detergent composition; (2) rinsing the fabrics in a bath which contains the above-described amounts of the fabric softener compositions; and (3) drying the fabrics. When multiple rinses are used, the fabric softening composition is preferably added to the final rinse. Fabric drying can take place either in an automatic dryer or in the open air.

PRODUCTION METHOD

In order to produce a stable liquid laundry detergent or fabric softener composition of the type described above, certain processing conditions should be met. First, the particle size of the fabric softening clay (longest dimension) must be reduced to less than about one micron; second, the antisettling agent and clay must be dispersed in the composition; and third, the antisettling agent's support matrix must be formed in the composition. This "activation" of the support matrix is accomplished when the composition exhibits plastic rheology.

These criteria are met by preparing a slurry of the clay, antisettling agent, water and polyol (and optional components, if so desired). The slurry is then passed through a colloid mill or other mixer which produces a shear rate greater than 10,000 $sec^{-1}$. This high shear mixing is repeated for about 4 to about 10 passes or until the composition is homogeneous and the antisettling agent is activated.

An alternative procedure for making the liquid laundry-care compositions comprises preparing a concentrated aqueous slurry of the Smectite-type clay and subjecting it to a shear rate greater than 10,000 $sec^{-1}$ for from about 4 to about 10 passes or until the composition is homogeneous and the antisettling agent is activated. Separately a solution containing the antisettling additive and other components (e.g., water, caustic, ethanol and alkyl aryl sulfonate) are subjected to a shear rate greater than 10,000 $sec^{-1}$ for from about 4 to about 10 passes. The two portions are then combined with the remaining ingredients using conventional agitation.

EXAMPLES 1-5

LIQUID DETERGENT COMPOSITIONS

Examples 1-5 are prepared in 1 gallon quantities by the following procedure:

The detersive ingredients and adjuncts, except the clay, antisettling additive and the clay-flocculating agent (if used), are mixed in a vessel equipped with a propeller mixer providing a shear rate of from about 100 $sec^{-1}$ to about 1,000 $sec^{-1}$. This mixing continues until this base formula appears clear and phase-stable; usually from about 15 to about 60 minutes. The antisettling agent and softening clay are added to the base formula and the entire mixture is stirred again using the propeller mixer described above for about 30 minutes. The resulting slurry is then passed through a colloid mill (model SD-40, distributed by Tekmar Co.) which provides a shear of from about 10,000 $sec^{-1}$ to about 40,000 $sec^{-1}$, about 4 to about 10 times, while maintaining a liquid temperature of from about 70° F. to about 100° F. This results in a suspension of clay particles having a longest particle dimension less than about 1 μm. Finally, the clay-flocculating agent (if used) is added slowly to the resulting mixture under gentle mixing conditions produced by a propeller mixer (i.e., a shear of from about 100 $sec^{-1}$ to about 1,000 $sec^{-1}$, for a period of at least about 5 minutes).

Finished compositions are stored under ambient conditions, where they remain homogeneous for months.

| | 1 | 2 | 3 | 4 | 5 |
|---|---|---|---|---|---|
| Dodecyl benzene sulfonate | 9% | 12% | 12% | — | 12% |
| Decyl benzene sulfonate | — | — | — | 15% | — |
| TEA coconut sulfate | 4% | 3% | 3% | — | — |
| Dodecyl dimethyl amine oxide | — | — | — | 5% | — |
| Coconut amidopropyl betaine | — | — | — | — | 5% |
| C14-15 alcohol ethoxylate (7 moles) | 11% | 8% | 10% | — | 10% |
| Dodecyl phenol etherethoxylate (5 moles) | — | — | — | 10% | — |
| Ethanol | 6% | 4% | 5% | 6% | 8% |
| Propylene glycol | 2% | 2% | 2% | — | 3% |
| Triethanolamine | 7% | 6% | — | — | 5% |
| Monoethanolamine | — | — | 5% | 4% | — |
| Coconut fatty acid | 9% | — | 8% | 12% | 12% |
| Oleic Acid | 3% | 2% | 2% | 2% | 4% |
| Dodecenyl succinic acid | — | 11% | 4% | — | — |
| Citric acid | 1% | 3% | 3% | — | 1% |
| Calcium bentonite (Cation Exchange Capacity = 100 meq/100 g) | 5% | 5% | — | 3% | — |
| Sodium hectorite (Cation Exchange Capacity = 100 meq/100 g) | — | — | 7% | — | 4% |
| M-P-A ® 14 anti-settling additive | 0.8% | 0.8% | 0.8% | — | — |
| Quaternized magnesium aluminum silicate | — | — | — | 0.6% | — |
| Fumed silica, (Amorphous Cabosil ® M-5, Cabot Corp. Particle Size 1 μm) | — | — | — | — | 1% |
| Polyethylene oxide (MW = 300,000) | — | 0.2% | — | — | — |

-continued

| | 1 | 2 | 3 | 4 | 5 |
|---|---|---|---|---|---|
| (Polyox WSR N750 ®, Union Carbide) | | | | | |
| Polyethylene oxide (MW = 4,000,000) (Polyox WSR 301 Union Carbide) | 0.03% | — | — | 0.07% | — |
| Polyethylene imine (MW = 500,000) | — | — | — | — | 0.1% |
| Water | 33% | 36% | 32% | 37% | 30% |
| Miscellaneous | Balance to 100% | | | | |

These compositions provide effective cleaning and thru-the-wash softening when used in the manner described above (see Methods of Use).

EXAMPLES 6 and 7

Rinse-Added Fabric Softener Compositions

Examples 6 and 7 are prepared in 1 gallon quantities by the following procedure.

The fabric softner ingredients and adjuncts, except the clay, antisettling additive and the clay-flocculating agent (if used), are mixed in a vessel equipped with a propeller mixer providing a shear rate of from about 100 $sec^{-1}$ to about 1,000 $sec^{-1}$. This mixing continues until this base formula appears clear and phase-stable; usually from about 15 to about 60 minutes. The antisettling agent and softening clay are added to the base formula and the entire mixture is stirred again using the propeller mixer described above for about 30 minutes. The resulting slurry is then passed through a colloid mill (model SD-40, manufactured by Tekmar Co.) which provides a shear of from about 10,000 $sec^{-1}$ to about 40,000 $sec^{-1}$, about 4 to about 10 times, while maintaining a liquid temperature of from about 70° F. to about 100° F. This results in a suspension of clay particles having a longest particle dimension less than about 1 μm. Finally, the clay-flocculating agent (if used) is added slowly to the resulting mixture under gentle mixing conditions produced by a propeller mixer (i.e., a shear of from about 100 $sec^{-1}$ to about 1,000 $sec^{-1}$, for a period of at least about 5 minutes).

Finished compositions are stored under ambient conditions, where they remain homogeneous for months.

| | 6 | 7 |
|---|---|---|
| Water | 40% | 30% |
| Glycerol | 5% | — |
| Stearyl Dimethyl Benzyl Ammonium Chloride | 2% | — |
| Ditallow Dimethyl Ammonium Chloride | — | 5% |
| Dimethicone | — | 15% |
| Ethanol | 20% | 30% |
| Isoamyl Alcohol | 10% | — |
| Olive Oil | — | 10% |
| Sodium Bentonite (Cation Exchange Capacity = 100 meq/100 g) | — | 5% |
| Sodium Hectorite (Cation Exchange Capacity = 100 meq/100 g) | 7% | — |
| Cabosil M-5 ® (Fumed Silica) | 1% | — |
| Bentone SD-2 ® (Organoclay) | — | 2.5% |
| Polyethylene Oxide (MW = 1,000,000) | — | 0.1% |
| Miscellaneous | Balance to 100 | |

These compositions provide effective softening when used in the manner described above (see Methods of Use).

SUSPENSION STABILITY TEST

Finished product suspensions are deaerated and transferred to transparent or translucent jars made of glass or plastic. Jars which are calibrated with a linear scale are preferred. The jars are placed in static storage inside a constant temperature room. Both 70° F. and 90° F. environments are employed to reflect normal ambient and stressed conditions. The height of liquids in each jar is measured at the time of storage and recorded. Samples are periodically monitored, and the amount of clay sedimentation in each product is measured by noting the height of clear liquid in the upper portion of the system. The size of this clear layer is expressed as a percentage of the height of the total product in the jar.

After at least 8 weeks of storage under these conditions, compositions 1–7 described above, exhibit less than 10% separation.

What is claimed is:

1. A stable liquid laundry care composition comprising:

(a) from about 1% to about 25%, by weight, of a Smectite-type clay having a longest individual particle dimension of less than about one micron and an ion exchange capacity of at least about 50 meq/100 g;

(b) from about 0.25% to about 5%, by weight, of an antisettling agent selected from the group consisting of organophillic organo-clays, fumed silicas or mixtures thereof;

(c) from about 5% to about 45% by weight of water; and (d) from 0% to about 5%, by weight, of a polyol containing from about 2 to about 6 carbon atoms and from about 2 to about 6 hydroxy groups, such that the combined water and polyol content of the composition does not exceed about 45%, by weight;

wherein said antisettling agent is sufficiently activated by high shear mixing such that said composition has a Brookfield Yield Value of at least about 1.5 dynes/cm$^2$.

2. A composition according to claim 1 further comprising an effective softness enhancing amount of a polymeric clay-flocculating agent.

3. A composition according to claim 2 wherein the clay-flocculating agent is a polymer derived from monomers selected from the group consisting of ethylene oxide, acryl amide, acrylic acid, dimethylamino ethyl methacrylate, vinyl alcohol, vinyl pyrrolidone, ethylene imine, and mixtures thereof.

4. A composition according to claim 3 wherein the polymeric clay-flocculating agent is polyethylene oxide with a molecular weight between about 300,000 and about 5,000,000.

5. A composition according to claim 4 comprising from about 0.001% to about 10%, by weight, of the polyethylene oxide clay-flocculating agent.

6. A composition according to claim 1 wherein the Smectite-type clay is selected from the group consisting of montmorillonites, volchonskoites, nontronites, hectorites, saponites, sauconites, vermiculites, and mixtures thereof.

7. A composition according to claim 6 wherein the Smectitetype clay is montmorillonite.

8. A composition according to claim 1 wherein the antisettling agent is an organophillic organo-clay comprising the reaction product of an organic cation containing at least one alkyl group containing at least 10 carbon atoms and a montmorillonite clay.

9. A composition according to claim 8 wherein the organic cation reagent is a quaternized ammonium cation.

10. A composition according to claim 1 wherein the polyol is selected from the group comprising of 1,2-propanediol, ethylene glycol, glycerol, and mixtures thereof.

11. A composition according to claim 10 wherein the polyol is 1,2-propanediol.

12. A composition according to claim 1 comprising (a) from about 2% to about 7%, by weight, of a montmorillonite clay, (b) from about 0.01% to about 0.3%, by weight, of polyethylene oxide with a molecular weight between about 300,000 and about 5,000,000, (c) from about 0.5% to about 2%, by weight, of an organophillic quaternized organo-montmorillonite antisettling agent and (d) a combined water and 1,2-propanediol content from about 5% to about 45%, by weight.

13. A liquid detergent composition according to claim 1 further comprising from about 1% to about 40%, by weight, of a detersive surfactant selected from the group consisting of anionic, nonionic, semi-polar, ampholytic, zwitterionic, and cationic surfactants, and mixtures thereof.

14. A composition according to claim 13 wherein the detersive surfactant is selected from the group consisting of linear alkyl benzene sulfonates, alkyl polyethoxylated alcohols, alkyl sulfates, and mixtures thereof.

15. A liquid fabric softener composition according to claim 1 further comprising from about 10% to about 55%, by weight, of liquid carrier selected from the group consisting of monohydric alcohols containing from about 1 to about 6 carbon atoms, and mixtures thereof.

16. A method for producing a stable liquid laundry care composition comprising the high shear mixing, at a shear rate of greater than about 10,000 sec$^{-1}$, at a liquid temperature from about 70° F. to about 100° F., for about 4 to about 10 passes, of a mixture comprising;

(a) from about 1% to about 25%, by weight, of a Smectite-type clay having an ion exchange capacity of at least about 50 meq/100 g;

(b) from about 0.5% to about 2%, by weight, of an antisettling agent selected from the group consisting of organophillic quaternized organo-clays, fumed silicas, and mixtures thereof;

(c) from about 5% to about 45%, by weight, of water; and (d) from 0% to about 5%, by weight, of a polyol containing from about 2 to about 6 carbon atoms and from about 2 to about 6 hydroxy groups, such that the combined water and polyol content of the composition does not exceed about 45%, by weight;

such that the fabric softening clay particle size is reduced to less than about one micron and the antisettling agent is fully dispersed and activated such that the composition has a Brookfield Yield Value of at least about 1.5 dynes/cm$^2$.

17. A method according to claim 16 wherein the mixture comprises from about 2% to about 7%, by weight, of a montmorillonite clay, an organophillic quaternized organomontmorillonite antisettling agent, and a combined water and 1,2-propanediol content from about 5% to about 45%, by weight.

18. A method according to claim 16 wherein the mixture further comprises an effective softness enhancing amount of a polymeric clay-flocculating agent.

19. A method according to claim 18 wherein the mixture comprises from about 2% to about 7%, by weight, of a montmorillonite clay, from about 0.01% to about 0.3%, by weight, of polyethylene oxide with a molecular weight between about 300,000 and about 5,000,000, an organophillic quaternized organo-montmorillonite antisettling agent, and a combined water and 1,2-propanediol content from about 5% to about 45, by weight.

20. A stable liquid laundry care composition produced in accordance with the process of claim 16.

21. A stable liquid laundry care composition produced in accordance with the process of claim 18.

22. A method of softening fabrics comprising the steps of:

(a) placing the fabrics in an aqueous solution;

(b) adding to the solution the composition according to claim 1 at a concentration from about 0.004% to about 2%, by weight; and (c) commencing agitation of the solution within about 5 minutes after step (b).

* * * * *

UNITED STATES PATENT AND TRADEMARK OFFICE

CERTIFICATE OF CORRECTION

PATENT NO. : 4,844,821

DATED : July 4, 1989

INVENTOR(S) : Robert Mermelstein, Frederick Anthony Hartman

It is certified that error appears in the above-identified patent and that said Letters Patent is hereby corrected as shown below:

Column 1, lines 31-32, the word "complele" should read --complete--.

Column 6, line 42, that portion of the equation reading "(D-D)" should read --$(D-D_o)$--.

Column 9, line 67, delete the word "moles".

Column 19, line 51, insert, as the beginning of a new paragraph, the sentence clause --A typical stable rinse-added softening composition comprises:--.

Signed and Sealed this

Eighth Day of May, 1990

*Attest:*

HARRY F. MANBECK, JR.

*Attesting Officer*

*Commissioner of Patents and Trademarks*